United States Patent [19]

Glaser

[11] Patent Number: 4,754,587

[45] Date of Patent: Jul. 5, 1988

[54] THERMAL BREAK PANEL

[76] Inventor: Donald L. Glaser, 515 Hampshire Rd., Akron, Ohio 44313

[21] Appl. No.: 944,925

[22] Filed: Dec. 22, 1986

[51] Int. Cl.[4] ..... E04C 1/00

[52] U.S. Cl. ..... 52/282; 52/309.11; 52/586; 52/730; 52/732

[58] Field of Search ..... 52/282, 285, 309.11, 52/309.9, 580, 586, 729, 732, 730, 785; 49/DIG. 1; 264/46.5, 46.6

[56] References Cited

U.S. PATENT DOCUMENTS

| | | | |
|---|---|---|---|
| 3,310,926 | 3/1967 | Brandreth et al. | 52/582 |
| 3,332,170 | 7/1967 | Bangs | 52/309.11 X |
| 3,496,689 | 2/1970 | Nerem | 52/309.9 X |
| 3,583,118 | 6/1971 | Lowery | 264/46.5 X |
| 3,729,880 | 5/1973 | Eliason | 52/309.11 X |
| 3,828,502 | 8/1974 | Carlsson | 52/580 X |
| 4,067,163 | 1/1978 | Hetman | 49/DIG. 1 |
| 4,128,934 | 12/1978 | Doring | 264/46.5 X |
| 4,275,526 | 6/1981 | Abramson | 52/731 X |
| 4,443,988 | 4/1984 | Coutu, Sr. | 52/586 X |
| 4,463,540 | 8/1984 | Gordon | 49/DIG. 1 |
| 4,486,994 | 12/1984 | Fisher et al. | 52/309.9 X |
| 4,542,614 | 9/1985 | Malachowski | 52/586 |
| 4,567,699 | 2/1986 | McClellan | 52/586 X |

FOREIGN PATENT DOCUMENTS

| | | | |
|---|---|---|---|
| 488634 | 8/1975 | Australia | 52/282 |
| 1245567 | 7/1967 | Fed. Rep. of Germany | 52/732 |
| 1581882 | 12/1980 | United Kingdom | 49/DIG. 1 |

*Primary Examiner*—Henry E. Raduazo

*Attorney, Agent, or Firm*—Renner, Kenner, Greive, Bobak & Taylor

[57] ABSTRACT

The present invention relates to composite wall panels (11), their construction and erection into buildings (10) so as to provide a true thermal break across each panel (11) and the several post constructions (70, 80, 120 & 130) employed to interconnect a successive series of such panels (11) into coplanar, corner and/or T-intersection arrangements. This result is obtained by providing each wall panel (11) with an insulating core (14) and having the frame members (13) of each panel (11), though themselves noninsulating, provided with a transverse web wall (18) and interim anchor means (19). When the interim anchor means (19) have sufficient structural integrity to maintain the frame members (13) into separated front and rear mullion strips (15 & 16) a bridge (22) is removed from the web wall (18). Such panels (11) have sufficient structural integrity to be transported and erected into buildings (10) by virtue of the several post constructions (70, 80, 120 & 130). Each post arrangement itself incorporates combinations of uniquely constructed and arranged interlocking members (60 & 95) that present permanent anchor means (65, 110 & 111) that operatively interconnect the opposed mullion strips (15 & 16) by an insulating compression member (76).

26 Claims, 4 Drawing Sheets

124
123
74
73
13
126
74
35
15
11F
120
63
18
20
22
14
19
21
18
121
65
60C
26
61
113
110
122
60B
76
74
111
95
100
68
102
108
73
119
76
68
75
38
125
61
101
29
71
16
35
74
13
74
26
65
71
29
62
18
106
15
16
11E
38
20
22
19
21
14
38
51
52
46
50
14
53
54
45
14
48
135

130
74
132
13
74
73
131
74
73
13
133
74
63
15
35
11H
15
26
35
11G
62
18
61
60D
65
119
65
60E
61
113
26
18
20
19
111
76
76
22
22
14
95A
110
14
21
68
29
111
95B
68
102
21
18
96
101
100
18
106
76
100
108
73
113
102
119
101
38
38
74
75
16
13
75
74
29
16
74
26
110
74
108
29
11J
106
15
16
35
38
18
20
22
18
19
21

THERMAL BREAK PANEL

TECHNICAL FIELD

The present invention relates to the physical construction and interconnection of composite panel walls, as well as the method for constructing and interconnecting the same. More particularly, the present invention relates to a means by which to incorporate a thermal break within such wall panels, and thus provide a thermal break within walls of a building structure fabricated from a successive series of such composite panels. Specifically, the present invention relates to: the structural configuration of composite wall panels employed to effect a true thermal break; the structural configuration of several post constructions by which to interconnect a successive series of such panels in coplanar, corner and/or T-intersection orientation so as to maintain the true thermal break provided by the wall panels themselves; and, a method by which to make said panels and secure a successive series thereof in selected coplanar, corner and/or T-intersection dispositions.

BACKGROUND ART

The prior art construction and use of composite wall panels is perhaps best exemplified by the disclosure of U.S. Pat. No. 3,310,926. The frame members for such wall panels are normally extruded from a metallic substance such as aluminum to provide a light weight, yet strong, frame that will impart structural integrity to the resulting panel. The facing, or skin, of such panels is also a preferably light weight material, such as a plastic sheeting material or a thin gauge metallic substance (in this situation, as well, aluminum may be satisfactorily employed). The frame members have historically been fastened together by suitable means such as rivets, bolts or other mechanical fasteners, and the facing materials have historically been secured to the frame members by an adhesive. The interior, or core, of each panel is usually filled with thermal, as well as sound, insulating materials. Typical core filler materials are polystyrene, or other plastic foams, fiberglass layers and even phenolic impregnated paper honeycomb sheets. In fact, virtually any type of core filler may be employed, so long as it provides the desired insulating qualities. Such panels are sufficiently rigid as to provide structural integrity to the walls constructed therefrom, and yet they are sufficiently light in weight that they can be manually manipulated with relative ease to facilitate the assembly and erection of walls in a building structure.

As is well known to the prior art, such panels may be erected upwardly of sill members supported from a foundation, roof or other relatively flat surface with considerable facility. The sill usually extends upwardly a sufficient extent so as to lie above the level of any water that would normally be expected to collect in proximity thereto. Doors, windows or other openings may be included, as desired or required. Even though such panels are frequently employed to erect structures that are preferably windowless, the panels are often required to be provided with openings to accommodate filters, duct work, louvers or the like.

Such panels are sufficiently air tight that they preclude the circulation of air therethrough, and the core material can be selected to prevent excess thermal conduction or radiation through the panels themselves. However, the material from which the frame members are normally constructed generally has rather high thermal conductivity. Because the surface area presented by the frame members is normally only a relatively small percentage of the overall surface area presented by the entire panel, the thermal loss occurring through the frame members themselves has been accepted as a necessary evil, and yet the cumulative heat loss by virtue of conduction through all the frame members in a building structure can be rather significant. As such, the thermal loss through the frame members has really been accepted only because there has not heretofore been an successful means by which to reduce, or eliminate, such losses.

GENERAL DISCLOSURE OF THE INVENTION

It is, therefore, a primary object of the present invention to provide a unique configuration for the frame member of a composite wall panel, the frame members incorporating a truly effective thermal break without compromising their own structural integrity.

It is a further object of the present invention to provide a frame member, as above, at least one embodiment of which incorporates an interim anchor means that will interact with the core of the panel in which the frame member is incorporated to provide at least the modest structural integrity necessary during assembly, transportation and erection of a plurality of such panels to form a wall.

It is a still further object of the present invention to provide a frame member, as above, which incorporates a bridge means that spans the aforesaid interim anchor means, the bridge means being be readily removable at such time as the interim anchor means is able effectively to interact with the core.

It is an even further object of the present invention to provide a composite wall panel that incorporates one or more frame members, as above, the said panels being erectable in successively adjacent coplanar, corner and/or T-intersection relation by virtue of unique post members, while maintaining the thermal break provided by said frame members.

It is another object of the present invention to provide a composite wall panel, as above, that incorporates one or more post members, also as above, with interlocking members which: effect an operative interconnection between frame members on successively adjacent panels; provide a permanent anchor means across the interim anchor means provided from the frame members of the individual panels; and, maintain the true thermal break provided by the frame members.

It is yet another object of the present invention to employ a thermal insulating material, which is normally weak in tension but relatively strong in compression, as a compression member in the structural arrangement by which to effect the permanent anchor means.

It is still another object of the present invention to employ interlocking members which structurally coact with thermal insulating material incorporated in the post members to utilize the compressive strength of that thermal insulating material in order to effect the desired permanent anchoring without compromising the insulating material and thereby achieve a true thermal break.

It is an additional object of the present invention to provide an alternative embodiment for an interim anchor means to be employed in those situations where the insulating material within the wall panel does not have at least some modest structural integrity.

It is yet an additional object of the present invention to provide not only a method for making frame members as well as composite wall panels, both as above, but also means for installing the same economically and with the greatest facility.

These and other objects of the present invention, as well as the advantages thereof over existing and prior art forms, which will be apparent in view of the following specification, are accomplished by means hereinafter described and claimed.

In general, a composite wall panel embodying the concepts of the present invention has an insulating core circumscribed by a plurality of frame members. The core is usually formed from at least two layers of insulating material. One of the layers of insulating material normally provides thermal insulation, and the other layer provides sound insulation. The insulating layers of the core are themselves generally covered with a facing, or skin, that is intended to protect the layers of insulating material, and, if necessary, or desirable, to present a decorative appearance to at least one surface of the panel. The decorative appearance may itself enhance at least the sound insulating quality of the panel.

The frame members that circumscribe the core of the wall panel are preferably fabricated from a material that permits the frame members to be extruded. The configuration of the individual frame members is such that they present front and rear mullion strips with a web wall extending transversely therebetween. A pair of interim anchor means are presented from the web wall, and that portion of the web wall extending between the interim anchor means constitutes a removable bridge. In that way when the bridge is removed an interim anchor means is located at the distal end of the web wall which extends outwardly from each mullion strip toward the opposed mullion strip when the insulating material employed admits of such an arrangement.

The pair of interim anchor means may cooperatively interact with a portion of the insulating core material such that the core material engages and retains the pair of interim anchor means in their opposed and spaced relation. This interaction thereby maintains the mullion strips on each frame member in their required disposition after the wall panels have been fabricated and until such time as they are incorporated in wall.

A plurality of individual interlocking members are secured to the mullion strips, and the interlocking members associated with opposed mullion strips interact with each other by virtue of an insulating material disposed therebetween which acts under compressive loading. Collectively, a plurality of interlocking members secure a successive assembly of composite wall panels in the desired coplanar, corner and/or T-intersection disposition and at the same time maintain the thermal break provided by the unique configuration of the frame and interlocking members.

A composite wall panel embodying the concepts of the present invention may be manufactured and erected by virtue of a method incorporating the following steps. A plurality of frame members are formed to permit each to be separated, when desired, into first and second mullion strips. For convenience the first mullion strip will sometimes be referred to as the front mullion strip, or even the outside mullion strip. Similarly, the second mullion strip will correspondingly be referred to as the rear mullion strip, or even the inside mullion strip. The designations front, rear, inside and outside are not intended to delineate any restricting limitation to the orientation of the wall panels with respect to the inside or outside of the building structure in which the panel are incorporated. Rather, those terms are intended to relate to the orientation of the filler materials in the core of the panels, as will hereinafter become more apparent.

The frame members are arranged to circumscribe what will become a core, and the core is formed within the boundaries described by the frame members. Interim anchor means are operatively presented from the mullion strips, and the interim anchor means may interact with the core to provide a means by which to maintain the relative position of the mullion strips of each frame member until such time as the panels are incorporated in a wall.

When the interim anchor means are thus enabled, the frame members are separated into first and second mullion strips. A series of these wall panels are disposed in the desired orientation with at least one frame member of each wall panel being at least partially adjacent a frame member in the next successive wall panel. Interlocking members are then secured to each mullion strip in the opposed frame members of the successively adjacent wall panels to provide a post construction. The interlocking members are provided in several distinct configurations. Selective use of the various interlocking members results in the unique post constructions by which to assemble the successive wall panels in the coplanar, corner and/or T-intersection dispositions desired. Each interlocking member is provided with a permanent anchor means, and the permanent anchor means secured to a first mullion strip is hooked over, and disposed in spaced relation with respect to, the interlocking member secured to the opposed, or second, mullion strip of the same frame member. An insulating material is interposed in the space between the opposed permanent anchor means to serve as a structural compression member and thereby effect the necessary structural connection between the first and second mullion strips of each frame member and at the same time ensure maintenance of the thermal break.

One preferred, and one alternative, embodiment of a composite wall panel, together with three varieties of the interlocking members employed to assemble the post constructions necessary to connect the successively adjacent wall panels in the desired coplanar, corner and/or T-intersection dispositions, are shown by way of example in the accompanying drawings without attempting to show all of the various forms and modifications in which the invention might be embodied; the invention being measured by the appended claims and not by the details of the specification.

BRIEF DESCRIPTION OF THE DRAWINGS

FIG. 4 is an enlarged view taken substantially on line 4—4 of FIG. 1 and depicting, in cross section, two successively adjacent wall panels oriented in a perpendicular disposition and conjoined at a corner post by the unique interlocking members, at least one of which constitutes a still further variation of the present invention;

DISCLOSURE OF EXEMPLARY EMBODIMENTS OF THE INVENTION

Figure 1:
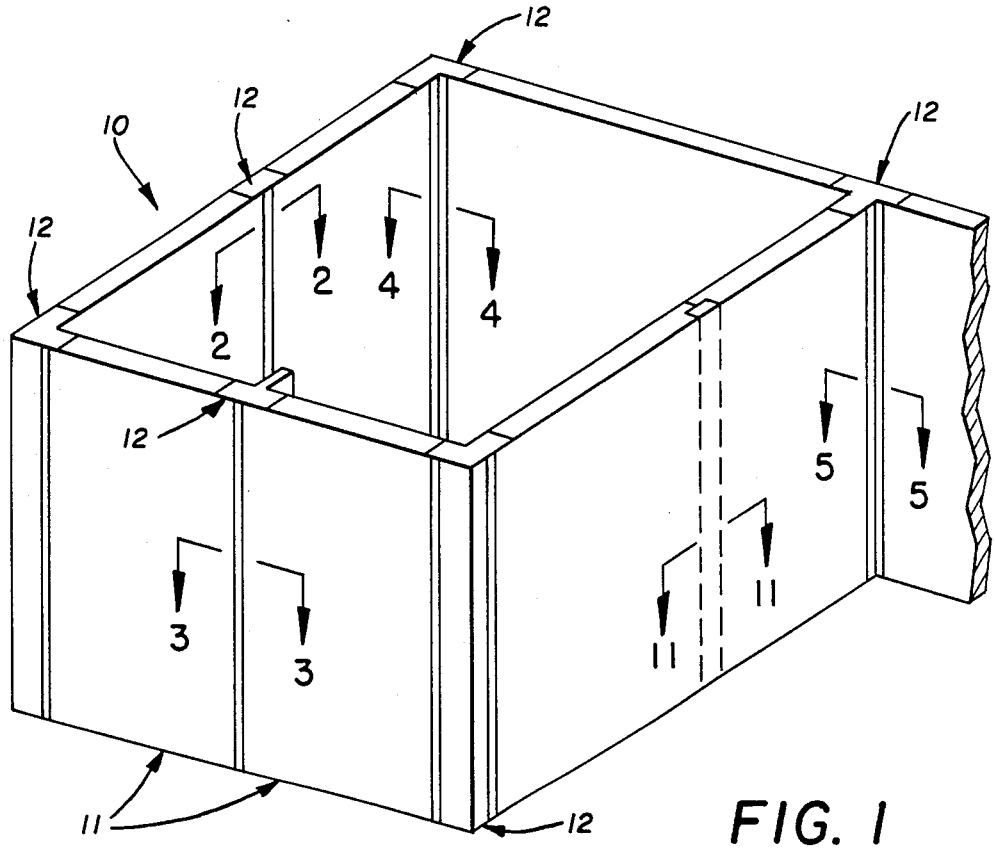
FIG. 1 is schematic perspective of a representative building structure fabricated from composite wall panels embodying the concept of the present invention.

A building structure 10, as shown by virtue of the pictorial representation in FIG. 1, may be fabricated from a plurality of composite wall panels 11 embodying the concept of the present invention, and the wall panels may preferably be joined together by one or more of a plurality of uniquely assembled post constructions, identified generally the numeral 12, which maintain the thermal break provided by the novel configuration of the wall panels 11.

As shown in FIGS. 2 through 5, inclusive, each wall panel 11 is circumscribed by a plurality of frame members 13 which define the perimeter thereof, and, as is hereinafter more fully explained, are of such configuration as to assure a true thermal break between the opposite faces of the wall panel 11.

The individual frame members 13 may be conveniently fabricated by an extrusion process, and each include what will become the first and second mullion strips 15 and 16, respectively A web wall 18 is integral with, and extends transversely between, said first, front or outside mullion strip 15 and said second, rear or inside mullion strip 16. To provide both the structural strength required for the building structure 10 in which the wall panels 11 are eventually to be incorporated and at the same time contribute to the overall light weight construction desired for a composite wall panel, the frame members 13 may be conveniently extruded from a substance such a aluminum.

Interim anchor means 19 are associated with the web wall 18 medially of the mullion strips 15 and 16. In that form of the frame member 13 depicted in FIGS. 2–5 and 9 the interim anchor means 19 comprises a pair of flanges 20 and 21 that extend transversely outwardly from the web wall 18. The flanges 20 and 21 are transversely spaced along the web wall 18 (i.e., laterally with respect to each other), and that portion of the web wall 18 that extends between the spaced flanges 21 and 22 constitutes a removable bridge 22.

In that type of interim anchor means 19 which employs a pair of spaced flanges 20 and 21, the flanges penetrate the material of the core 14, and that portion of the core 14 which envelops the spaced flanges serves as a tensile member which operatively interconnects the flanges 20 and 21 to maintain the disposition of the mullion strips 15 and 16, one with respect to the other, after the bridge 22 has been removed and until such time as the wall panel 11 is incorporated in a structure.

In addition to the flanges 20 and 21, a pair of ribs 23 and 24 also extend outwardly of the web wall 18, one in proximal, spaced relation to each mullion strip 15 and 16. The ribs 23 and 24 extend outwardly of the web wall 18 in a direction opposite to that of the flanges 20 and 21 which form the interim anchor means 19. As such, the mullion strip 15, the rib 23 (located in spaced, proximal relation to the mullion strip 15) and that portion 25 of the web wall 18 extending therebetween forms a sealing cavity 26. Similarly, the mullion strip 16, the rib 24 (located in spaced, proximal relation to the mullion strip 16) and that portion 28 of the web wall 18 extending therebetween forms a sealing cavity 29. Each mullion strip 15 and 16 has a rear wall 27, and the ribs 23 and 24 have boundary surfaces 23A and 24A, respectively. The rear wall 27 on the mullion strip 15 and the boundary surface 23A on rib 23 face toward the sealing cavity 26. Similarly, the rear wall 27 on mullion strip 16 and the boundary surface 24A on rib 24 face toward the sealing cavity 29. The rear surfaces 27 and the boundary surfaces 23A and 24A are each provided with a plurality of stria 30 that are preferably oriented parallel to the web wall 18. In order to obviate unnecessary replication of the numbers on the drawings, the several surfaces of the members forming the sealing cavities are only numbered in FIGS. 2 and 9.

The mullion strips 15 and 16 in each frame member 13 are also provided with obverse faces 31 and 32, respectively, and the obverse faces 31 and 32 each present a mounting recess 33. The peripheral edges 34 of a first, front or outside facing sheet 35 overlie, and are received within, the mounting recess 33 in the obverse face 31 of the mullion strips 15 in each frame member 13 defining the periphery of the composite wall panel 11. Similarly, the peripheral edges 36 of a second, rear or inside facing sheet 38 overlie, and are received within, the mounting recess 33 in the obverse face 32 of the mullion strips 16 in each frame member 13 defining the periphery of the same composite wall panel 11. When the wall panels are secured in a building 10, the peripheral edges 34 and 36 of the front and rear facing sheets 35 and 38, respectively, will be more permanently secured to the frame members 13, as will be hereinafter more fully explained, but prior to their permanent installation, the peripheral edges 34 and 36 of the facing sheets 35 and 38 may be sufficiently secured to the mounting recesses 33 in the mullion strips 15 and 16 of the frame members 13 by use of a metal bonding adhesive 39.

To facilitate the use of an adhesive 39, the mounting recesses 33 may be provided with a groove 40 that parallels, and lies contiguous with, the shoulder 41 forming the juncture of the reveal 42 on the obverse faces 31 and 32 with the mounting recess 33 on each mullion strip 15 and 16. Not only to present an aesthetically pleasing appearance, but also to obviate the possibility that the exposed peripheral edges 34 and 36 might present cutting edges, the plane of each mounting recess 33 is preferably offset from the plane of the reveal 42 associated therewith a distance equal to the thickness of the material from which the facing sheets 35 and 38 are fashioned.

The facing sheets 35 and 38 function primarily to afford at least a modicum of protection to the core 14 of the wall panels 11. In addition, the facing sheets may provide a desired decorative appearance to the wall panels. In fact, it is also possible for the facing sheets functionally to contribute to the insulating purposes of the panels. For example, the facing sheet 38 may be perforated to enhance the sound insulating characteristics of the panel, as provided by the core 14 which is now more fully to be described.

The core 14 is preferably formed from a material, or materials, that will provide the desired insulating qualities. For example, to provide both sound and thermal insulation one may employ two distinct insulating layers 45 and 46 in the core 14. A typical thermal insulation layer 45 may comprise a substantially rigid, closed cell foam such as polyurethane. On the other hand, a typical insulation layer 46 may employ a sound absorptive material such as mineral wool or fiberglass. Such sound absorptive materials have relatively little structural integrity. Thus, by comparison to the sound insulating material, the thermal insulation has rather substantial structural integrity. Accordingly, the thermal layer 45 of the core 14 is preferably disposed transversely to span the flanges 20 and 21 of the interim anchor means 19 such that when the bridge 22 is removed, the mechanical interaction between the interim anchor means 19 and the thermal insulation layer 45 of the core 14 will retain, at least until such time as the composite wall panel is permanently installed in a building, the relative disposition of the opposed mullion strips 15 and 16 forming the frame members 13.

Even though the peripheral edges of the facing sheets may be sufficiently bonded to the frame members 13 by virtue of the adhesive 39, the span of the facing sheets which extends between the frame members also preferably requires some stabilization. The facing sheet 35 which overlies an insulating layer having some structural integrity, such as the thermal insulation layer 45 described herein, may itself be bonded to the layer 45, as by an adhesive 48. However, the poor structural integrity of the sound insulation layer 46 heretofore described would preclude stabilization of the facing sheet 38 by bonding that facing sheet 38 to insulated layer 46. As such, it has been found highly desirable to achieve stabilization of the facing sheet 38 lying adjacent to the sound insulating layer 46 by the use of one or more dead men 50.

Figures 5, 11:
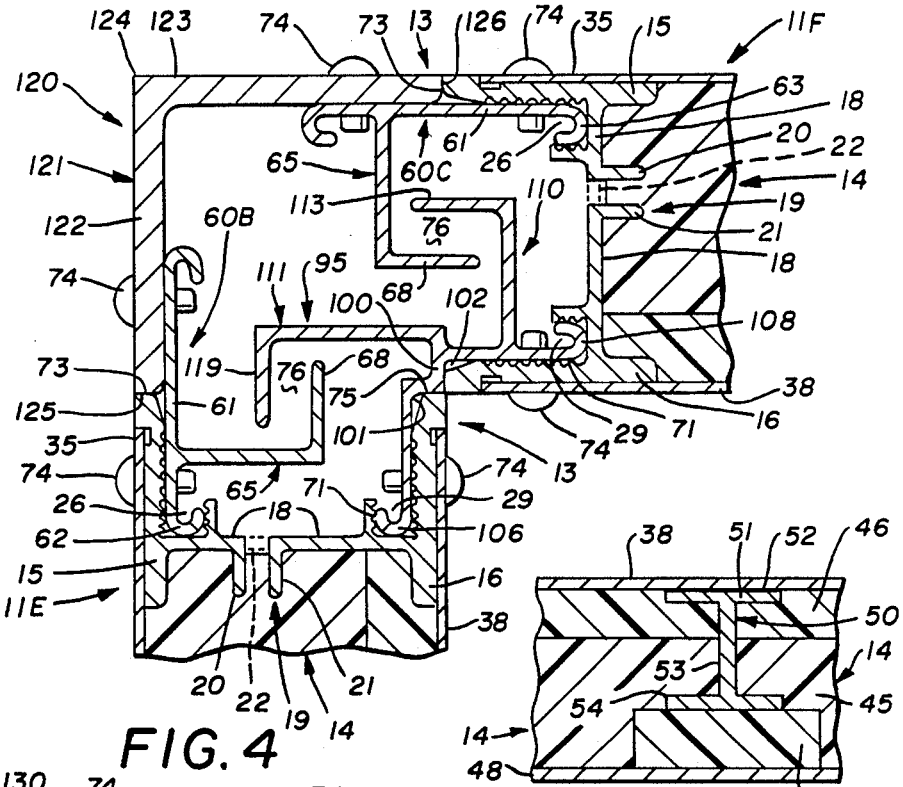
FIG. 5 is an enlarged view taken substantially on line 5—5 of FIG. 1 and depicting, in cross section, three convergingly adjacent wall panels oriented in an intersecting disposition and conjoined at a T-intersection post by a plurality of unique interlocking members.
FIG. 11 is an enlarged cross section, taken substantially along line 9—9 of FIG. 1 and appearing on the same sheet of drawings as FIGS. 4 and 5, depicting one form of a dead man arrangement whereby to stabilize that facing sheet that lies in contiguous juxtaposition to an insulation layer having no structural integrity.

As best seen in FIG. 11, a dead man 50 may have a foot portion 51 that is secured to the facing sheet 38, which lies adjacent the sound insulating layer 46, as by a suitable adhesive 52. A dead man web 53 extends transversely outwardly of the foot portion 51, through the sound insulating layer 46 and into the thermal insulating layer 45. A head portion 54, or other suitable means, is provided on the extremity of the web 53 most remote with respect to the foot portion 51 to effect a mechanical bond with the material forming the thermal insulating layer 45 whereby to stabilize the facing sheet 38 which lies in contiguous juxtaposition with the sound insulating layer 46.

Figure 12:
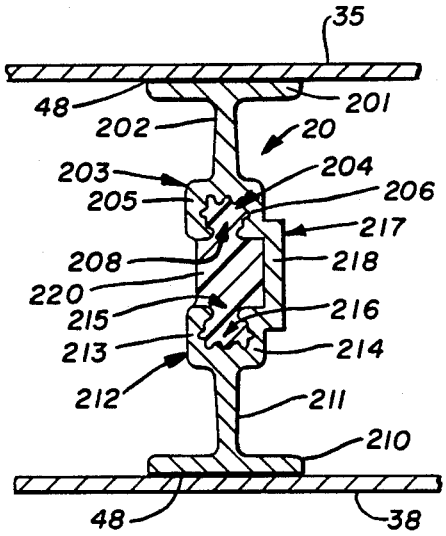
FIG. 12 is a cross section appearing on the same sheet of drawings as FIG. 1 and depicting an alternative web wall arrangement that can be employed transversely to connect the spaced facing sheets of a web wall or transversely to connect the mullion strips of a frame member and at the same time maintain a thermal break across the wall panel in which this variation of the web wall is incorporated—the web wall arrangement being depicted before having been debridged; and, FIG. 13, also appearing on the same sheet of drawings as FIG. 1, is a cross sectional view similar to FIG. 12 but depicting the web wall as having been debridged to provide the discontinuity along the length of the web wall which effects the thermal break.
Figure 13:
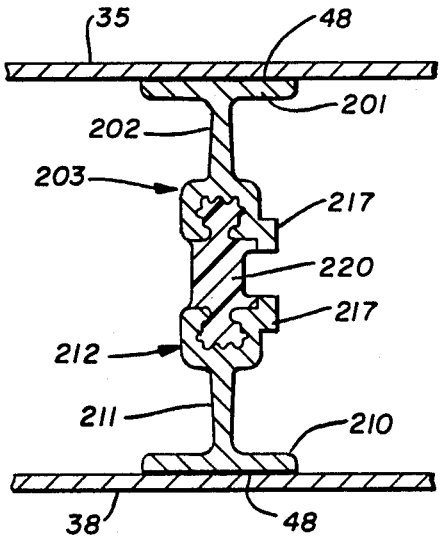

It should be appreciated that in some situations the entire core may comprise a thermal insulating material which possesses some structural integrity, such as layer 45, and in that situation both the front and rear facing sheets 35 and 38 may be bonded directly to the core 14 by an adhesive 48 to provide the desired stabilization to the facing sheets. To the contrary, it is also quite conceivable that for some installations the sound insulation may itself impart a sufficient thermal insulation to the core, or it may be desirable to employ a thermal insulating material that does not itself possess sufficient structural integrity to permit either facing sheet to be bonded thereto for stabilization. In those situations means may be provided to stabilize the front and rear facing sheets directly to each other, if such means effects the necessary thermal break. As such, an alternative to the dead man 50 is contemplated within the scope of the present invention. Specifically an interconnecting web 200, as depicted in FIGS. 12 and 13, and as hereinafter described in detail, may well be employed.

Figure 6:
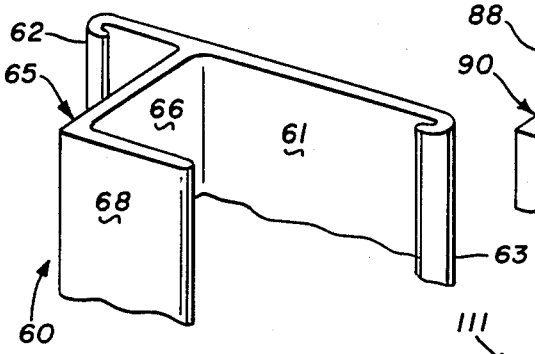
FIG. 6 is a perspective view, appearing on the same sheet of drawings as FIG. 3, and depicting one form of the unique interlocking members employed to join successively adjacent wall panels according to the concept of the present invention.

Returning now to the description of the exemplary embodiments of the present invention, and particularly that aspect thereof pertaining to the erection and interconnection of a plurality of web walls 11 in a building structure 10, it should be appreciated that in order to arrange successive wall panels 11 in the desired disposition, and also to maintain the desired thermal break, a plurality of uniquely configured interlocking members 60 are preferably employed. The basic interlocking member 60, as is depicted in FIG. 6, has a gusset plate 61. The gusset plate 61 has first and second end portions 62 and 63, respectively, which, as will be hereinafter more fully described, may present rolled edges selectively to fit within, and engage, the sealing cavities 26 and 29 provided in the frame members 13. A permanent anchor means 65, which includes a leg member 66 and a foot flange 68, is presented from the gusset plate 61 of each interlocking member 60. The leg member 66 extends transversely outwardly from the gusset plate 61 and terminates in the foot flange 68 that is oriented substantially perpendicularly with respect to the leg member 66 and extends outwardly of the leg member toward the second end portion 63 of the gusset plate 61.

The dimension between the first end portion 62 of the gusset plate 61 and the point at which the leg member 66 of the permanent anchor means 65 conjoins with the gusset plate 61 is preferably equal to approximately one third the distance between the first and second end portions 62 and 63.

Figures 2, 9:
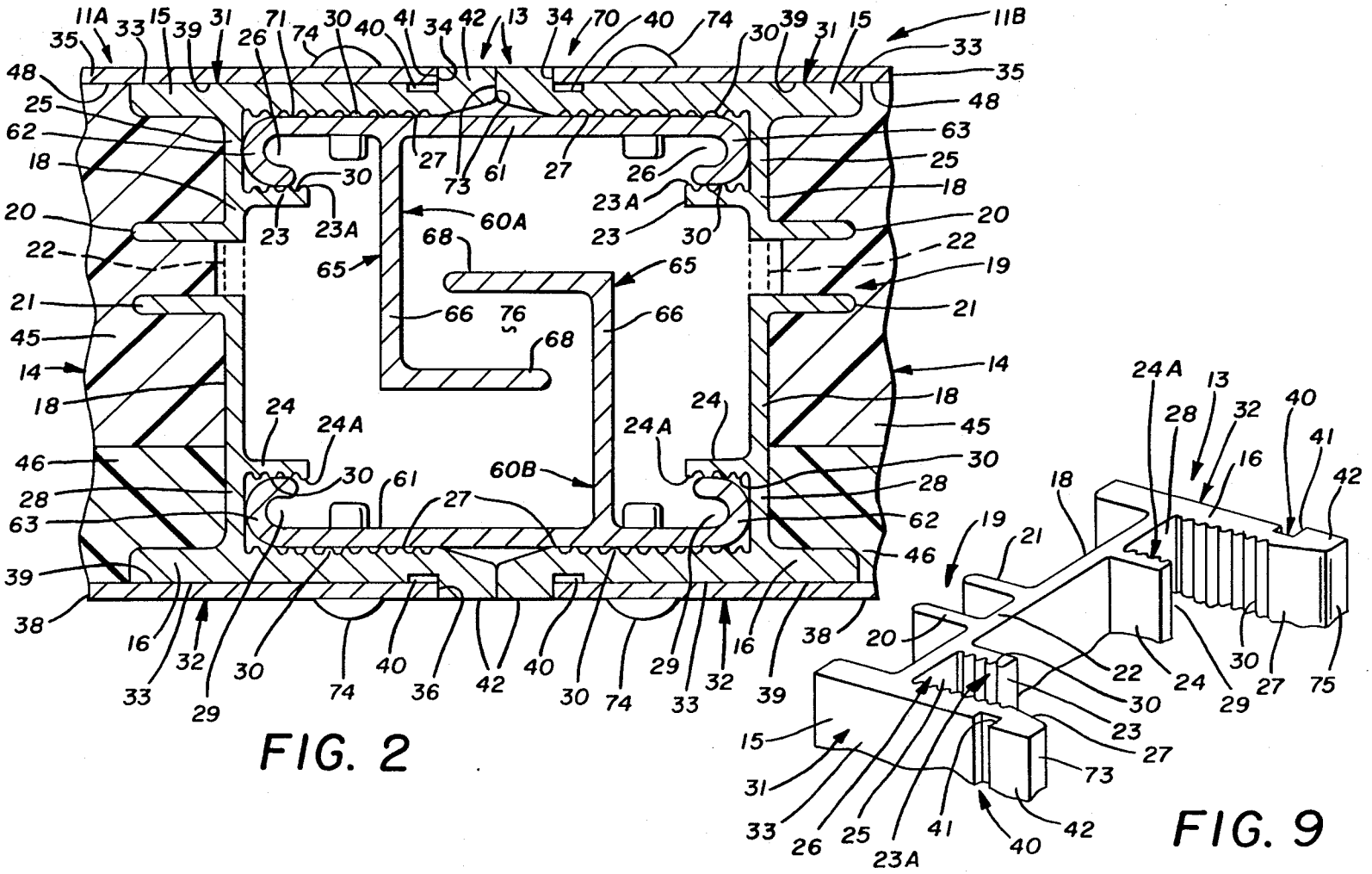
FIG. 2 is a considerably enlarged view taken substantially on line 2—2 of FIG. 1 and depicting, in cross section, two successively adjacent wall panels oriented in linear, or coplanar, disposition and conjoined at a coplanar post by one variety of the unique interlocking members which embodies a further concept of the present invention.
FIG. 9 is a perspective view, appearing on the same sheet of drawings as FIG. 2, and depicting one, unique form for a frame member that can be employed in a composite wall panel to provide an interim anchor means that will interact with the panel core, said frame member being depicted without having been debridged.

A pair of the basic interlocking members 60 may be employed to secure successively adjacent wall panels 11 in a linear, or coplanar, disposition. As is best depicted in FIG. 2, a pair of composite wall panels 11A and 11B are disposed in linear disposition with the adjacent frame members 13 on each being conjoined by a pair of the basic interlocking members 60 which are themselves individually depicted in FIG. 6. This arrangement of the frame members 13 and the interlocking members depicted in FIG. 2 is designated as the coplanar post construction 70.

In the coplanar post construction 70 the first end portion 62 of the gusset plate 61 in interlocking member 60A is received in the sealing cavity 26 located behind, and in proximal relation to, the mullion strip 15 of the frame member 13 in panel 11A, and the second end portion 63 of the gusset plate 61 is similarly received within the sealing cavity 26 located behind, and in proximal relation to, the mullion strip 15 of the frame member 13 in panel 11B. A caulking material 71, such as a butyl rubber, is preferably interposed between each end portion 62 and 63 of the gusset plate 61 provided on interlocking member 60A and the sealing cavities 26 in which the end portions 62 and 63 are received. The stria 30 allow a sufficient abundance of the caulking material 71 to be retained within the sealing cavities 26 to effect the necessary seal, the purpose for which will hereinafter be explained, between the end portions 62 and 63 and the cavities 26.

With the gusset plate 61 of interlocking member 60A seated within the opposed sealing cavities 26 of the frame members 13 in the successive panels 11A and 11B, the return surface 73 on each mullion strip 15 of the two frame members 13 in the successively adjacent wall panels 11A and 11B will preferably abut, as represented in FIG. 2. With the interlocking member 60A so disposed with respect to the mullion strips 15 of the frame members 13 of panels 11A and 11B, a plurality of permanent fastening means are applied to secure the mullion strips 15 to the gusset plate 61 of interlocking member 60A. As shown, a plurality of rivets 74 may be employed at spaced intervals along the length of the two mullion strips 15. These rivets 74 will also serve to effect a more permanent means by which to affix the front facing sheets 35 to the mounting recesses 33 in the front mullion strips 15 of the frame members 13 in panels 11A and 11B.

Similarly, the first end portion 62 of the gusset plate 61 in interlocking member 60B is received within the sealing cavity 29 of the mullion strip 16 of the frame member 13 in panel 11B, and the second end portion 63 of the gusset plate 61 in interlocking member 60B is received within the sealing cavity 29 of the mullion strip 16 of the frame member 13 in panel 11A. A caulking material 71 is also preferably interposed between the end portions 62 and 63 of the gusset plate 61 in interlocking member 60B and the sealing cavities 29, and the stria 30 associated with the sealing cavities 29 assure the retention of a sufficient quantity of the caulking material 71 within the cavities 29 to effect the desired seal.

A plurality of rivets 74 may also be disposed at spaced intervals along the length of the two mullion strips 16 to serve as the permanent fastening means by which to secure the mullion strips 16 of the frame members 13 in panels 11A and 11B to the gusset plate 61 of the interlocking member 60B when the return surface 75 of the two mullion strips 16 abut. These rivets 74 may also serve to affix the rear facing sheets 38 to the mounting recesses 33 in the rear mullion strips 16 of the frame members 13 in panel 11A and 11B.

The permanent anchor means 65 of the basic interlocking member 60A is hooked over and disposed in spaced relation with respect to the permanent anchor means 65 of the basic interlocking member 60B. This physical arrangement is accomplished by virtue of the fact that the leg members 66 in the permanent anchor means 65 of each interlocking member 60A and 60B extend outwardly of their respective gusset plates 61 at a point closer to the one end portion 62 than the other end portion 63. As such, the leg members 66 of the two basic interlocking members 60A and 60B are offset with respect to each other in the arrangement of the coplanar post construction 70. That offset disposition of the leg members 66, coupled with the fact that the length of each leg member 66 is greater than one half the thickness of the wall panels 11, allows the foot flanges 68 of the two permanent anchor means 65 to overlie each other in spaced relation.

An insulating compression member 76 is received between the foot flanges 68 of the interlocking members 60A and 60B, and the member 76 is chosen to provide the strength necessary permanently to maintain the mullion strips 15 and 16 of the adjacent frame members 13 in the successive wall panels 11A and 11B at the dimensional separation to which they were held by the web walls 18 before the bridges 22 were removed—and successively thereafter by the interim anchor means 19. As will be hereinafter more fully described in conjunction with the description of the method by which the panels are erected, the desired compression member may be inserted between the hooked foot flanges 68 on the opposed permanent anchor means 65 by foaming, frothing or pouring a suitable insulating material in situ.

Figure 7:
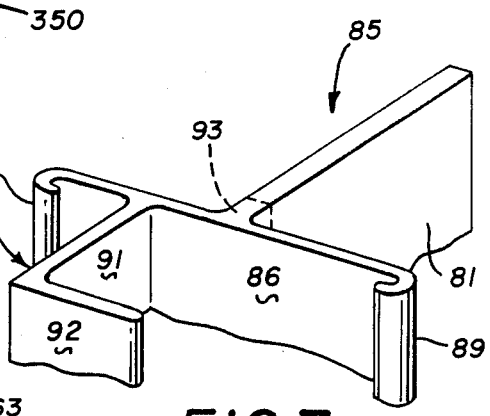
FIG. 7 is a perspective view, appearing on the same sheet of drawings as FIG. 6, and depicting another form of the unique interlocking members, which, with a slight change, represents an even further variation of the interlocking members employed to join successively adjacent wall panels according to the concept of the present invention.
Figure 3:
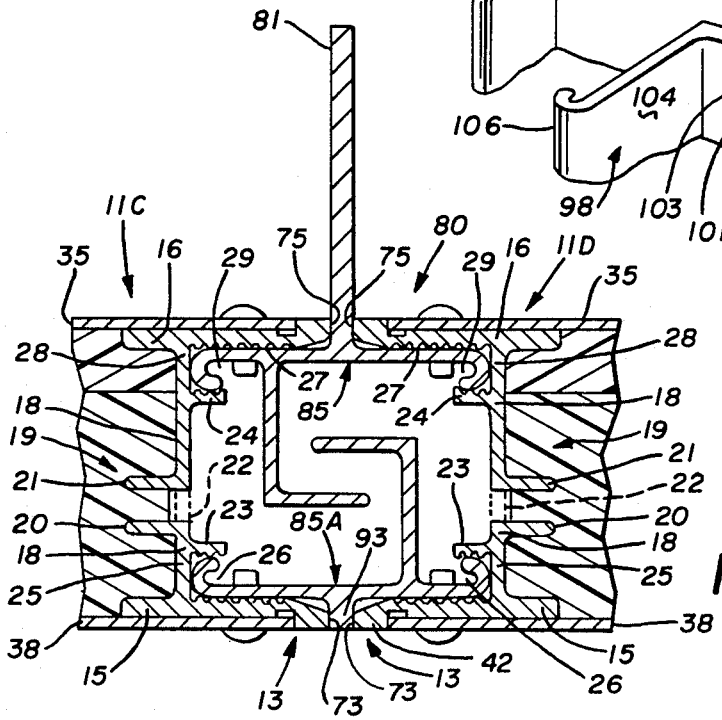
FIG. 3 is an enlarged view taken substantially on line 3—3 of FIG. 1 and depicting, in cross section, two successively adjacent wall panels oriented in linear, or coplanar, disposition and conjoined at a coplanar connecting post by alternative forms of the unique interlocking members which embody further concepts of the present invention and which present a blade-like, mounting flange on at least one side of the coplanar post construction effecting the joinder.

An alternative, coplanar post construction 80 by which to arrange successive wall panels 11 in a linear disposition, and at the same time to provide a blade-like tab 81 by which to effect a facile, mounting connection between the wall in which the panels are employed and a structural device, or other fixture, external to and adjacent said wall is depicted in FIG. 3. The alternative, coplanar post arrangement 80 employs one or more variants of the basic interlocking member 60. Specifically, the flanged variety of the basic interlocking member is designated by the numeral 85, and two variants thereof are described in conjunction with FIG. 7.

The flanged interlocking member 85 also has a gusset plate 86, and the gusset plate 86 has first and second end portions 88 and 89, respectively, which may also comprise rolled edges. The flanged interlocking member 85 is similarly provided with a permanent anchor means 90. Anchor means 90 includes a leg member 91 that extends transversely outwardly from the gusset plate 86 and terminates in a foot portion 92. The dimension between the first end portion 88 and the point at which the permanent anchor means 90 conjoins with the gusset plate 86 is also preferably equal to approximately one third the distance between the first and second end portions 88 and 89. The flanged interlocking member 85 differs from the basic interlocking member 60 in that a tab extends outwardly of the gusset plate 86 medially the end portions 88 and 89 on that side of the gusset plate 86 opposite the side from which the permanent anchor means 90 extends. The tab may comprise the previously identified tab extension 81 or a tab stub 93.

When the flanged interlocking members 85 are incorporated in an alternative, coplanar post construction 80 the tab extension 81, by virtue of its location medially the first and second end portions 88 and 89 of the gusset plate 86, will extend outwardly between, and will be abutted by, the return surface 75 on each mullion strip 16 of the two frame members 13 in the successively adjacent wall panels 11C and 11D, as depicted in FIG. 3. Should it be desired to provide a tab extension 81 only on one side of the wall, the second flanged interlocking member 85A is provided with a tab stub 93. The tab stub 93 is likewise disposed medially of the two end portions 88 and 89, and it will extend outwardly of the gusset plate 86 sufficiently to be abutted by the return surface 73 on each mullion strip 15 of the two frame members 13 in the successively adjacent wall panels 11C and 11D. Because the tab extension 81 and the tab stub 93 are of equal thickness, the abutment by each with the respective return surfaces 73 and 75 will provide a structurally balanced arrangement across the alternative, coplanar post arrangement 80.

It should now also be apparent that one could employ two flanged interlocking members 85 that each present a tab extension 81 should it be necessary, or desirable, to effect a connection between the wall and some external devices on both sides of the wall. In either event the flanged interlocking members 85 will be secured to, and within the alternative, coplanar post arrangement 80 in the same manner as the basic interlocking members 60 are secured within the coplanar post construction 70.

Figure 8:
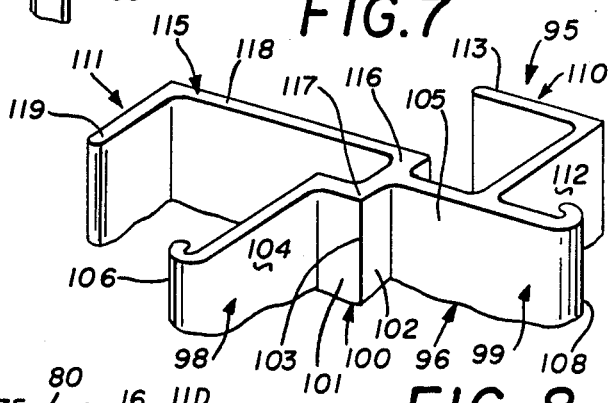
FIG. 8 is a perspective view, also appearing on the same sheet of drawings as FIG. 6, and depicting yet another form of the unique interlocking members employed to join successively adjacent wall panels according to the concept of the present invention.

Further variations in the post constructions by which to interconnect successive wall panels may require the use of an angled interlocking member 95, as is clearly depicted in FIG. 8. The angled interlocking member 95 is also provided with a gusset plate, but the gusset plate 96 in the angled interlocking member 95 is comprised of a pair of connector flanges 98 and 99 disposed in angular, generally perpendicular, relation, one to the other. The connector flanges 98 and 99 meet at an abutment offset 100 which extends toward the interior of the angle at which the two connector flanges 98 and 99 meet. The exterior surfaces 101 and 102 of the abutment offset meet at an apex 103, and the dimension of the two exterior surfaces 101 and 102, measured between the apex 103 and the surfaces 104 and 105 of the connector flanges 98 and 99 intersected by the abutment offset 100, are preferably equal to the thickness of the mullion strips 15 or 16 that will engage the exterior surfaces 101 and 102 when the angled interlocking member 95 is installed in an appropriate post construction.

The first end portion 106 of the gusset plate 96 presents a rolled edge on the terminal end of the connector flange 98, and the second end portion 108 of the gusset plate 96 similarly presents a rolled edge at the terminal end of the connector flange 99. The edges forming the two end portions 106 and 108 are both rolled away from the surfaces 104 and 105 that intersect the abutment offset 100.

The angled interlocking member 95 incorporates two permanent anchor means 110 and 111, both of which extend outwardly from the connector flange 99. The leg member 112 of the first permanent anchor means 110 is conjoined with, and extends outwardly from, the medial portion of the connector flange 99 and terminates in a foot flange 113 that extends in a direction away from the second end portion 108.

A dog leg member 115 in the second permanent anchor means 111 is conjoined with, and extends outwardly of, that end of the connector flange 99 closest to the abutment offset 100. A spur portion 116 of the dog leg member 115 extends outwardly of the connector flange 99 at the juncture thereof with the abutment offset 100, and, in fact, the spur portion 116 aligns with that wall 117 of the abutment offset 100 which presents the exterior surface 102. The main portion 118 of the dog leg member 115 extends laterally of the spur portion 116 in a direction away from the first permanent interlocking member 110 and terminates in a foot flange 119 that extends generally toward the first end portion 106.

A corner post construction 120, as is depicted in FIG. 4, employs an angled interlocking member 95 in combination with two basic interlocking members 60 to effect a desired corner arrangement. A pair of composite wall panels 11E and 11F are disposed in a corner arrangement with the mullion strips 16 of the adjacent frame members 13 in the successive wall panels 11E and 11F lying substantially contiguous at the inside of the corner. As such, the mullion strips 15 in the said frame members 13 are disposed in spaced relation at the outside of the corner. A corner filler plate 121 has angled legs 122 and 123 which meet at a vertex 124 that defines the outside edge of the corner post arrangement 120.

The first end portion 106 of the angled interlocking member 95 is received within the sealing cavity 29 of the mullion strip 16 in the frame member 13 of panel 11E, and the second end portion 108 of the angled interlocking member 95 is received within the sealing cavity 29 of the mullion strip 16 in the frame member 13 of wall panel 11F. A suitable caulking material 71 is interposed between the end portions 106 and 108 and the sealing cavities 29 in which the end portions are so received, as heretofore described. With the end portions of the gusset plate 96 so disposed within the sealing cavities 29, the return surface 75 on each mullion strip 16 will abut the respective exterior surfaces 101 and 102 of the abutment offset 100. A plurality of rivets, or other fastening means, 74 may then be applied at spaced intervals along the length of the two mullion strips 16 not only to secure the angled interlocking member 95 thereto, but also to effect a more permanent means by which to affix the rear facing sheets 38 of the wall panels 11E and 11F to the respective mullion strips 16.

The first end portion 62 of a basic interlocking member 60B is received, and caulked, within the sealing cavity 26 of the mullion strip 15 in the frame member 13 of wall panel 11E and with the edge 125 of the angled leg 122 in filler plate 121 abutting the return surface 73 on the mullion strip 15 of the frame member 13 in wall panel 11E a plurality of rivets, or other fastening means, 74 may be employed to secure the gusset plate 61 of the basic interlocking member 60B not only to the mullion strip 15 but also to the angled leg 122 of the filler plate 121. Those fastening means which engage the mullion strip 15 also effect a more permanent arrangement by which to secure the front facing sheet 35 on wall panel 11E to the mullion strip 15 of that panel.

With the basic interlocking member 60B so secured, the foot flange 68 of the permanent anchor means 65 is hooked over and disposed in spaced relation with respect to the foot flange 119 of the permanent anchor means 111 on the angled interlocking member 95. An insulating compression member 76 may also be interposed between the foot flanges 68 and 119, as hereinbefore described, to maintain the mullion strips 15 and 16 of the frame member 13 in wall panel 11E in the desired disposition.

The second end portion 63 of a basic interlocking member 60C is received, and caulked, within the sealing cavity 26 of the mullion strip 15 in the frame member 13 of wall panel 11F, and with the edge 126 of the angled leg 123 in filler plate 121 abutting the return surface 73 on the mullion strip 15 of the frame member 13 in wall panel 11F a plurality of rivets, or other fastening means, 74 may be employed to secure the gusset plate 61 of the basic interlocking member 60C not only to the mullion strip 15 but also the angled leg 123 of the filler plate 121. Those fastening means which engage the mullion strip 15 also effect a more permanent arrangement by which to secure the front facing sheet 35 on wall panel 11F to the mullion strip 15 of that panel.

With the basic interlocking member 60C so secured, the foot flange 68 of the permanent anchor means 65 is hooked over and disposed in spaced relation with respect to the foot flange 113 of the permanent anchor means 110 on the angled interlocking member 95. An insulating compression member 76 may also be interposed between the foot flanges 68 and 113, as hereinbefore described, to maintain the mullion strips 15 and 16 of the frame member 13 in wall panel 11F in the desired disposition.

A T-intersection post construction 130, as is depicted in FIG. 5, employs two angled interlocking members 95 in combination with two basic interlocking members 60 to effect a desired T-intersection arrangement. A pair of composite wall panels 11G and 11H are linearly disposed, but longitudinally spaced, to conjoin with a third wall panel 11J in a T-intersection arrangement with the mullion strip 16 of the frame member 13 in the wall panels 11G lying substantially contiguous to the the mullion strip 15 of the frame member 13 in the wall panel 11J at one inside corner of the T-intersection. Similarly, the mullion strip 16 of the frame member 13 in the wall panel 11H lies substantially contiguous to the mullion strip 16 of the frame member 13 in the wall panel 11J. So disposed, the return surfaces 73 of the mullion strips 15 in the frame members 13 of the wall panels 11G and 11H lie spaced, but aligned, at the outside of the T-intersection post arrangement 130. A flat filler plate 131 is aligned with, and is disposed between, the spaced mullion strips 15 of the wall panels 11G and 11H.

The first end portion 106 of the angled interlocking member 95A is received within the sealing cavity 29 of the mullion strip 16 in the frame member 13 of panel 11G, and the second end portion 108 of the angled interlocking member 95A is received within the sealing cavity 26 of the mullion strip 15 in the frame member 13 of wall panel 11J. A suitable caulking material 71 is interposed between the end portions 106 and 108 and the respective sealing cavities 29 and 26 in which the end portions are so received, as heretofore described. With the end portions of the gusset plate 96 so disposed within the sealing cavities 26 an 29, the return surface 75 on mullion strip 16 of wall panel 11G will abut the exterior surface 101 on the abutment offset 100 of the angled interlocking member 95A, and the return surface 73 on mullion strip 15 of wall panel 11J will abut the exterior surface 102 on the abutment offset 100 of angled interlocking member 95A. A plurality of rivets, or other fastening means, 74 may then be applied at spaced intervals along the length of the two contiguous mullion strips 15 and 16 of panels 11J and 11G, respectively, not only to secure the angled interlocking member 95A thereto, but also to effect a more permanent means by which to affix both the rear facing sheet 38 of the wall panel 11G to the mullion strip 16 and the front facing sheet 35 of the wall panel 11J to the mullion strip 15.

The first end portion 106 of the angled interlocking member 95B is received within the sealing cavity 29 of the mullion strip 16 in the frame member 13 of panel 11J, and the second end portion 108 of the angled interlocking member 95B is received within the sealing cavity 29 of the mullion strip 16 in the frame member 13 of wall panel 11H. A suitable caulking material 71 is interposed between the end portions 106 and 108 and the sealing cavities 29 in which the end portions are so received, as heretofore described. With the end portions of the gusset plate 96 so disposed within the sealing cavities 29, the return surface 75 on mullion strip 16 of wall panel 11J will abut the exterior surface 101 on the abutment offset 100 of the angled interlocking member 95B, and the return surface 75 on mullion strip 16 of wall panel 11H will abut the exterior surface 102 on the abutment offset 100 of angled interlocking member 95B. A plurality of rivets, or other fastening means, 74 may then be applied at spaced intervals along the length of the two contiguous mullion strips 16 of panels 11H and 11J not only to secure the angled interlocking member 95B thereto, but also to effect a more permanent means by which to affix both the rear facing sheets 38 of the wall panels 11H and 11J to the respective mullion strips 16.

With the angled interlocking members 95A and 95B so secured, the foot flange 113 of the permanent anchor means 110 on the angled interlocking member 95A is hooked over and disposed in spaced relation with respect to the foot flange 119 of the permanent anchor means 111 on the angled interlocking member 95B. An insulating compression member 76 may also be interposed between the foot flanges 113 and 119, as hereinbefore described, to maintain the mullion strips 15 and 16 of the frame member 13 in wall panel 11J in the desired disposition.

The first end portion 62 of a basic interlocking member 60D is received, and caulked, within the sealing cavity 26 of the mullion strip 15 in wall panel 11G, and with the first edge 132 of the flat filler plate 131 abutting the return surface 73 on the mullion strip 15 of the frame member 13 in wall panel 11G a plurality of rivets, or other fastening means, 74 may be employed to secure the gusset plate 61 of the basic interlocking member 60D not only to the mullion strip 15 of wall panel 11G but also to the flat filler plate 131. Those fastening means which engage the mullion strip 15 also effect a more permanent arrangement by which to secure the front facing sheet 35 on wall panel 11G to the mullion strip 15 of that panel.

With the basic interlocking member 60D so secured, the foot flange 68 of the permanent anchor means 65 thereon is hooked over and disposed in spaced relation with respect to the foot flange 119 of the permanent anchor means 111 on the angled interlocking member 95A. An insulating compression member 76 may also be interposed between the foot flanges 68 and 119, as hereinbefore described, to maintain the mullion strips 15 and 16 of the wall panel 11G in the desired disposition.

Similarly, the second end portion 63 of a basic interlocking member 60E is received, and caulked, within the sealing cavity 26 of the mullion strip 15 in wall panel 11H, and with the second edge 133 of the flat filler plate 131 abutting the return surface 73 on the mullion strip 15 of the frame member 13 in wall panel 11H a plurality of rivets, or other fastening means, 74 may be employed to secure the gusset plate 61 of the basic interlocking member 60E not only to the mullion strip 15 but also to the flat filler plate 131. Those fastening means which engage the mullion strip 15 also effect a more permanent arrangement by which to secure the front facing sheet 35 on wall panel 11H to the mullion strip 15 of that panel.

With the basic interlocking member 60E so secured, the foot flange 68 of the permanent anchor means 65 is hooked over and disposed in spaced relation with respect to the foot flange 113 of the permanent anchor means 110 on the angled interlocking member 95B. An insulating compression member 76 may also be interposed between the foot flanges 68 and 113, as hereinbefore described, to maintain the mullion strips 15 and 16 of the wall panel 11H in the desired disposition.

Turning now to a detailed description of the alternative form of the interconnecting web 200 depicted in FIGS. 12 and 13, which web 200 is particularly adaptable to be employed as a strut member between the opposed facing sheets, that web has a foot portion 201 that may be secured to the front facing sheet 35 as by an adhesive 48. A web wall 202 extends transversely outwardly from the foot portion 201 and terminates in an anchor head 203. The anchor head 203 must have a configuration that will permit it to effect a mechanical interconnection to an insulating material received therein, and to that purpose the configuration of a generally clevis-shaped head portion having a bight 204 defined by lateral walls 205 and 206 that taper to a mouth portion 208 of lesser dimensional span than the widest portion of the bight 204 will serve quite well.

The interconnecting web 200 is also provided with a second foot portion 210 that may be secured to the rear facing sheet 38, as by an adhesive 48. A web wall 211 extends transversely outwardly from the foot portion 210, and it too terminates in an anchor head 212, preferably of similar configuration to the opposed anchor head 203, with lateral walls 213 and 214 which converge to a mouth 215 and which define a bight 216 therebetween of greater lateral dimension than the lateral dimension of the mouth 215.

The opposed, and generally aligned, side walls 206 and 214 of the anchor heads 203 and 212, respectively, are interconnected by a plate 217 that includes a removable bridge portion 218. A strip 220 of plastic material having relatively nonconductive thermal characteristics is formed within, and spans between, the opposed anchor heads 203 and 212. The strip 220 may be formed of a rigid thermoplastic material such a polyethylene or polypropylene that can be introduced to harden in situ. Thereafter, the bridge 218 may be removed, as depicted in FIG. 13. Such an arrangement effects the desired thermal break and yet affords sufficient structural integrity to the interconnecting web 200 that the web 200 can effectively stabilize the transversely spaced facing sheets 35 and 38, respectively.

Figure 10:
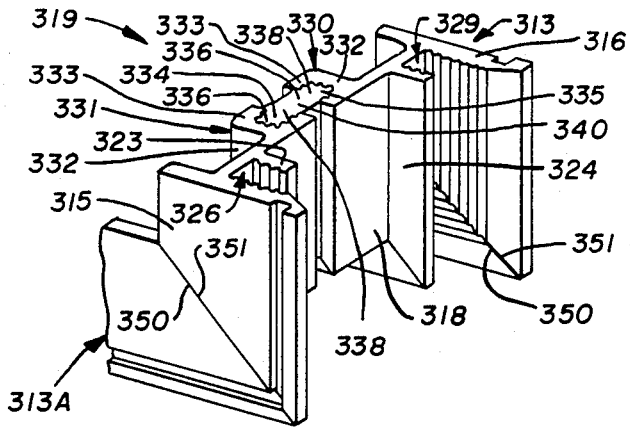
FIG. 10 is a perspective view similar to FIG. 9, but appearing on the same sheet of drawings as FIGS. 3 and 6–8, and depicting an alternative, unique form for a frame member that can be employed in a composite wall panel to provide an interim anchor means that need not interact with the panel core, said frame member being depicted after having been debridged.

The anchor head arrangement employed in conjunction with the interconnecting web 200 may also be adapted for incorporation as an interim anchor means 319 in the alternative form of the frame member 313 depicted in FIG. 10 should the heretofore described arrangement of flanges 20 and 21 not be desirable for a particular installation. Notably this would occur in those situations where the core material does not posses sufficient structural integrity effectively to coact with an interim anchor means 19 that employs flanges 20 and 21.

The alternative frame member 313, like the frame member 13, employs first and second mullion strips 315 and 316, respectively, that are separated by a web wall 318 which is integral with the mullion strips 315 and 316 and extends therebetween.

The frame member 313 is also provided with ribs 323 and 324 associated with the respective mullion strips 315 and 316 to form striated sealing cavities 326 and 329, respectively.

Distinctly different, however, is the fact that the flanges 20 and 21 are replaced with L-shaped flanges 320 and 321. One leg 332 of each flange 320 and 321 extends perpendicularly outwardly of the web wall 318, and the second leg of each flange 320 and 321 presents a side wall 333 that lies in generally parallel relation with the web wall 318 to form opposed, clevis-shaped head portions 334 and 335. Each head portion has a mouth portion 336 and a bight 338 of greater lateral dimension than the mouth portion 336.

A strip 340 of plastic material plastic material having relatively nonconductive thermal characteristics is formed within, and spans between, the opposed head portions 334 and 335. The strip 340 may be formed of a rigid thermoplastic material such a polyethylene or polypropylene that can be introduced to harden in situ. A portion of the web wall 318 forming a bridge similar to that employed with the interconnecting web 200 may be removed after the strip 340 has hardened, as depicted in FIG. 10 to effect the desired thermal break and yet constitutes an interim anchor means until the panel employing the alternative frame member 313 is incorporated in a wall panel 11.

FIG. 10 also depicts the fact that, if desired, the frame member 313, or in a similar fashion, frame member 13, may be successively joined, end-to-end, to circumscribe the core 14 of a wall panel 11 by mitered joints. As shown, the frame member 313 is provided with a mitered end, as at 350, to engage a matingly mitered end 351 on frame member 313A. The mitered ends 350 and 351 of the metallic frame members 313 and 313A may be permanently joined, as by spot welding at desired locations along the juxtaposed ends of the successively disposed frame members, so long as the weld does not span the discontinuity provided by debridging the web wall 318.

The method of erecting and interconnecting a plurality of wall panels 11 in a building structure 10 should be fairly apparent in view of the detailed description of the wall panels heretofore set forth, but at least certain aspects as the assembly of the wall panels themselves may not yet be fully apparent. One convenient method by which to assemble the wall panels themselves would be to secure the desired dead men 50 at spaced intervals along the inside surface of the rear facing sheet 38 and then adhere the assembled rear facing sheet 38 and dead men 50 to the frame members 13 which have been assembled to define the periphery of the finished panel 11. That is the edges 36 of the rear facing sheet are received within the mounting recesses 33 of what will become the rear mullion strips 16 of the frame members 13. By placing the thus partially assembled panel 11 on a work surface with the rear facing sheet presented downwardly, one can distribute a layer of sound insulation 46 on top of the rear facing sheet 38 and around the dead men 50 within the boundary of the panel 11 defined by the frame members 13.

Thereafter a block 135 (as depicted in FIG. 11) of foamed thermal insulating material is disposed along the head portion 54 of the dead men 50. The thickness of the block 135 is preferably selected so that it will not inhibit placement of the front facing sheet 35 onto the assembled frame members 13 with the edges 34 thereof received in the mounting recess 33 of what will become the front mullion strip 15 of the frame members 13. The adhesive 39 is applied to the back of the front facing sheet 35 so that the thermal insulation layer 45 will bond to the facing sheet 35 as that layer is formed. The components which will foam to produce the thermal insulation layer 45, as is well known to the art, are then introduced onto the sound insulation layer 46 in the cavity of the core 14 that will comprise the thermal layer 45, and the front facing sheet 35 is thereupon bonded to the appropriate mounting recesses 33.

With the components thus assembled, the panel 11 is turned over to rest on the front facing sheet 35. By having selected the width of the block 135 to extend sufficiently past the lateral edges of the head portion 54 on the dead men 50 the block 135 will prevent the loose layer of sound insulation 46 from dropping below the level of the head portion 54. In that way as the thermal insulation foams, froths or is poured to form layer 45 it will tend modestly to compress the sound insulation layer against the rear facing sheet 38, and when the thermal layer 45 hardens the panel can be further processed to provide the thermal break. That is, after the layer 45 hardens the frame members 13 can be debridged to provide a discontinuity that extends the length of the web wall 18 and lies parallel to the mullion strips 15 and 16. Debridging is accomplished by removing that portion 22 of the web wall 18 which lies between the flanges 20 and 21 which form the interim anchor means 19.

For debridging to be effective it is mandatory that the interim anchor means coact with a substance that has sufficient structural integrity to maintain the relative transverse separation of the mullion strips 15 and 16 after the bridge 22 has been removed. In one form of the invention disclosed herein the coaction of the transversely spaced flanges 20 and 21 with the thermal insulation layer 45 accomplishes that result. It is, of course, also possible to employ a web wall 318 that incorporates the interim anchor means 319, as is depicted in FIG. 10 and which has heretofore been explained in detail.

Once the wall panels 11 are so assembled they may be transported to the construction site and incorporated in a building structure 10 by virtue of the heretofore described interlocking members 60 and 95, as appropriate. After the panels 11 are arranged in the various dispositions required to erect the building structure 10 an insulating material, such as employed to provide the thermal insulation layer 45, may be introduced into the several post construction between the successive wall panels 11. As that material foams, froths or is poured in situ it will form the compression member 76 that is interposed between the permanent anchor means on the various interlocking members 60, 85 and 95 to provide the required structural integrity to the erected wall panels 11.

It should now be appreciated that the sealing cavities 26 and 29 provide an effective means by which to retain the insulation material within the post arrangements as the foaming, or frothing, action occurs.

It should now also be apparent that a wall panel embodying the concepts of the present invention and erected in a successive series by virtue of the post constructions herein disclosed provides a truly effective thermal break and otherwise accomplishes the objects of the invention.

I claim:

1. A composite panel comprising:

a plurality of frame members defining the perimeter of said composite panel;

a panel core circumscribed by said frame members;

said core comprising discrete layers, one primarily to effect sound insulation and the second primarily to effect thermal insulation;

the sound insulation lies adjacent to one facing sheet and the thermal insulation lies adjacent the second facing sheet;

the sound insulation has relatively little tensile integrity and the thermal insulation has, by comparison to the sound insulation, rather substantial tensile integrity;

a dead man being secured to that facing sheet adjacent the sound insulation layer;

said dead man extending transversely outwardly of that facing sheet to which it is secured, through said sound insulation layer and into the said thermal insulation layer;

a head portion being provided on said dead man within the thermal insulation layer by which to effect a mechanical interlock with the material forming said thermal insulation layer;

each frame member having front and rear mullion strips with a web wall extending transversely between said mullion strips;

the mullion strips of each frame member have an obverse face that presents a mounting recess adjacent said core;

front and rear facing sheets overlie said core;

said front and rear facing sheets each have peripheral edges;

the peripheral edges of said facing sheets overlie, and are received within, the mounting recess in the obverse face of the mullion strips in each frame member defining the perimeter of the composite panel;

adhesion means provide at least an interim connection between said front and rear facing sheets and said mounting recess in the mullion strip on each frame member defining the periphery of the composite panel;

a pair of transversely spaced, interim anchor flanges extending outward of said web wall and penetrating said core;

at least that portion of said core penetrated by said interim anchor flanges serves as a tensile member operative between said interim anchor means; and the web wall between said interim anchor flanges presenting a bridge that is removable when the integrity of the core is such that the mechanical interaction between the core and the interim anchor flanges will maintain the transverse spacing of the mullion strips without said bridge.

2. A composite panel, as set forth in claim 1, wherein:

the thermal layer of insulation comprises a closed cell, rigid foam.

3. A post construction by which to secure successively adjacent composite panels so as to maintain a thermal break across not only the panels but also said post construction:

each said panel having frame members circumscribing an insulating core;

said frame members each comprising front and rear mullion strips;

a web wall extending between said mullions strips;

a discontinuity extending parallel to said mullion strips for the length of said web wall;

insulating, interim locking means operatively to span said discontinuity and maintain the spacing of said web wall across said discontinuity;

at least two interlocking members, one said interlocking member secured to the mullion strip of each frame member;

at least one permanent anchor means presented from each said interlocking member;

the permanent anchor means presented from that interlocking member secured to the one mullion strip of said frame member being hooked over and being disposed in spaced relation with respect to the permanent anchor means presented from that interlocking member secured to the other mullion strip of said frame member; and, an insulating compression member received between the permanent anchor members so hooked, one with respect to the other.

4. A post construction, as set forth in claim 3, wherein:

said adjacent, composite panels are coplanar;

each said interlocking member having a gusset plate;

each said gusset plate underlying aligned mullion strips on successively adjacent, coplanar frame members;

fastening means to secure said mullion strips to said underlying gusset plate

5. A post construction, as set forth in claim 4, in which each permanent anchor means comprises:

a leg member extending transversely outwardly of the gusset plate and terminating in a foot flange oriented substantially perpendicularly with respect to said leg member.

6. A post construction, as set forth in claim 5, wherein:

said gusset plate has first and second end portions;

the dimension between said first end portion and said leg member being equal to approximately one third the distance between said the first and second end portions; and, said foot member extending outwardly of the leg member toward said second end portion.

7. A post construction, as set forth in claim 4, wherein:

a sealing cavity is provided at the juncture of each web wall with its respective mullion strip;

said end portions of the gusset plates being received within the sealing cavities of the adjacent frame members joined by said interlocking members.

8. A post construction, as set forth in claim 7, wherein:

a rib extends transversely outwardly of said web wall in proximal, spaced relation to at least one said mullion-strip;

said-mullion strip, said rib and that portion of the web wall therebetween forming the said sealing cavity associated with said mullion strip.

9. A post construction, as set forth in claim 8, wherein:

stria are provided on at least one of the structural elements defining said sealing cavity;

said stria being oriented substantially parallel to said web wall.

10. A post construction, as set forth in claim 9, wherein:

a caulking material is received within said stria to effect a seal between that portion of said gusset plate received within said sealing cavity and the frame member in which said sealing cavity is located.

11. A post construction, as set forth in claim 4, wherein:

said interlocking members each have a tab extending outwardly of said gusset plate, and on the opposite side thereof with respect to said permanent anchor means;

said tab extending transversely between the adjacent mullion strips on successive frame members.

12. A post construction, as set forth in claim 11, wherein:

the tab on at least one of said interlocking members presents an extension flange by which an external fixture can be connected to said post.

13. A post construction, as set forth in claim 12, wherein:

the tab on one of said interlocking members is stubbed such that it terminates in substantially the same plane as the obverse face of the said adjacent mullion strips between which it extends.

14. A post construction, as set forth in claim 13, wherein:

said tab is located medially the end portions of said gusset plate.

15. A post construction, as set forth in claim 3, wherein:

said adjacent, composite panels are disposed in a corner arrangement;

the frame members on the successively adjacent composite panels determine said corner;

each frame member presents a mullion strip on the inside of said corner arrangement, the inside mullion strip on one said frame member being substantially contiguous to the inside mullion strip on the other of said frame members that determines the corner arrangement;

each said frame member also presents a mullion strip on the outside of said corner arrangement;

a corner filler plate is employed;

said corner filler plate has angled legs, each leg terminating in a longitudinal edge;

each longitudinal edge of said corner filler plate is disposed adjacent to one of the outside mullion strips on said frame members that determine the corner arrangement;

a basic interlocking member is secured between each outside mullion strip and said corner filler plate;

an angled interlocking member is secured between said inside mullion strips.

16. A post construction, as set forth in claim 15, wherein:

each said angled interlocking member has a gusset plate;

said gusset plate on the angled interlocking member is comprised of a pair of connector flanges disposed in angular relation, one to the other.

17. A post construction, as set forth in claims 16, wherein:

an abutment offset is provided;

the connector flanges of said gusset plate join to said abutment offset;

said abutment offset presents an apex;

said abutment offset extends outwardly of each said connector flange on that side of said connector flange opposite said anchor means.

18. A post connector, as set forth in claim 3, wherein:

said adjacent, composite panels are three in number and are arranged in a T-intersection disposition;

the frame members on the successively adjacent composite panels determine said T-intersection;

two of said composite panels arranged in said T-intersection are coplanar;

each frame member on said two coplanar panels in the T-intersection have first and second mullion strips;

the third said composite panel in said T-intersection is disposed in substantially perpendicular disposition with respect to said two, coplanar panels;

the mullion strips of the frame member determining the T-intersection on said third composite panel are each substantially contiguous to the first mullion strips in the frame members of said opposed coplanar panels;

an angled interlocking member is secured between said substantially contiguous mullion strips;

a filler plate extends between the second mullion strips in the frame member of said opposed coplanar panels;

a basic interlocking member is secured between each said second mullion strips and said filler plate.

19. A post construction, as set forth in claim 18, wherein:

each said angled interlocking member has a gusset plate;

said gusset plate on the angled interlocking member is comprised of a pair of connector flanges disposed in angular relation, one to the other;

a pair of permanent anchor means being presented from the gusset plate of said angled interlocking member, said permanent anchor means being disposed in substantially the same angular disposition as said connector flanges;

at least one permanent anchor means on each said angled interlocking member being hooked over, and being disposed in spaced relation with respect to, the permanent anchor means presented from one of said basic interlocking members.

20. A post construction, as set forth in claim 19, wherein:

an abutment offset is presented at the juncture of the connector flanges of said gusset plate;

said abutment offset extends outwardly of each said connector flange on that side of said connector flange opposite said anchor means.

21. A method for providing a composite panel wall having a thermal break, said method comprising the steps of:

assembling a plurality of composite insulating panels having non-insulating frame members capable of being separated into front and rear mullion strips, spaced, opposed facing sheets, an insulating core disposed between said facing sheets and being circumscribed by said frame members;

providing an insulating interim anchor means temporarily to maintain the relative disposition of said mullion strips;

separating each said frame member into discrete front and rear mullion strips;

locating a series of composite panels in the desired orientation with said frame member being successively adjacent;

securing interlocking members to each mullion strip;

hooking a permanent anchor means on the interlocking member secured to each mullion strip over, and in spaced, opposed relation, with respect to the permanent anchor means on the interlocking member secured to the opposed mullion strip of each said frame member;

interposing an insulating compression member in the space between said opposed permanent anchor means.

22. A method for providing a composite panel wall having a thermal break, as set forth in claim 21, comprising the further steps of:

foaming an insulating material in situ to form the insulating compression member.

23. A method for providing a composite panel wall having a thermal break, as set forth in claim 22, comprising the further steps of:

sealing the interlocking members to the mullion strips to which they are secured to contain the insulating material foamed in situ.

24. A method for providing a composite panel wall having a thermal break, as set forth in claim 23, comprising the further steps of:

disposing at least one dead man in contact with at least one facing sheet of the panel, said dead man extending toward the opposed facing sheet;

fastening the dead man to the facing sheet contacted thereby;

providing a head on the dead man to effect an anchor within the core.

25. A method for providing a composite panel wall having a thermal break, as set forth in claim 24, comprising the further steps of:

installing a first layer of insulation in contiguous juxtaposition to that facing sheet to which the dead man is fastened;

foaming a second layer on insulation between the said first layer and the opposed facing sheet.

26. A method for providing a composite panel wall having a thermal break, as set forth in claim 25, comprising the further steps of:

inserting a block of relatively rigid insulation between the head of the dead man and the opposed facing sheet to retain the first layer of insulation at or above the level of the head during foaming of said second layer of insulation.

* * * * *